US006677541B1

(12) United States Patent
Rapeli

(10) Patent No.: US 6,677,541 B1
(45) **Date of Patent: *Jan. 13, 2004**

(54) KEYBOARD AND KEY AND TELEPHONE APPARATUS WITH SUCH A KEYBOARD

(75) Inventor: Juha Rapeli, Changel (FR)

(73) Assignee: Nokia Mobile Phones Limited, Espoo (FI)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 1,036 days.

(21) Appl. No.: 08/981,676

(22) PCT Filed: Jul. 10, 1996

(86) PCT No.: PCT/FI96/00404

§ 371 (c)(1),
(2), (4) Date: Mar. 23, 1998

(87) PCT Pub. No.: WO97/04472

PCT Pub. Date: Feb. 6, 1997

(30) Foreign Application Priority Data

Jul. 24, 1995 (FI) ..... 953551

(51) Int. Cl.[7] ..... H01H 9/00

(52) U.S. Cl. ..... 200/5 A; 200/18; 200/512; 200/562

(58) Field of Search ..... 200/1 B, 18, 512, 200/513, 562, 339, 5 A, 6 A; 400/485; 341/22

(56) References Cited

U.S. PATENT DOCUMENTS

| | | | | | |
|---|---|---|---|---|---|
| 2,849,549 | A | * | 8/1958 | Elliot | 200/6 A |
| 3,483,337 | A | * | 12/1969 | Johnstone et al. | 200/6 A |
| 4,034,176 | A | | 7/1977 | Larson | 200/159 B |
| 5,172,101 | A | * | 12/1992 | Bates | 341/34 X |
| 5,186,555 | A | * | 2/1993 | Chiba | 400/485 |
| 5,235,636 | A | | 8/1993 | Takagi et al. | 379/368 |
| 5,266,949 | A | | 11/1993 | Rossi | 341/22 |
| 5,408,060 | A | | 4/1995 | Muurinen | 200/314 |
| 5,528,235 | A | * | 6/1996 | Lin et al. | 341/22 |
| 5,536,911 | A | * | 7/1996 | Madill | 200/6 A |
| 5,861,823 | A | * | 1/1999 | Straunch et al. | 200/5 R |
| 6,157,323 | A | * | 12/2000 | Tso et al. | 200/5 A |
| 6,303,887 | B1 | * | 10/2001 | Ando | 200/512 |

FOREIGN PATENT DOCUMENTS

| | | |
|---|---|---|
| EP | 0 441 993 A1 | 8/1991 |
| EP | 0 520 159 A1 | 12/1992 |
| GB | 2 081 512 A1 | 2/1982 |
| SE | 356 384 | 5/1973 |

* cited by examiner

*Primary Examiner*—Renee Luebke
(74) *Attorney, Agent, or Firm*—Perman & Green, LLP

(57) ABSTRACT

A keyboard having keys for inputting characters, wherein a key is arranged to produce a character in response to the press of the key once. The key (30) has a main contact (31) which is always activated when the key (30) is pressed. Also the key has at least one edge contact (32, 33), which is activated, in addition to the main contact (31), when the key (30) is pressed at the point or close to the point of the edge contact (32, 33). The activation of predetermined contacts correspond to the inputting of a predetermined character.

17 Claims, 3 Drawing Sheets

Figure 4A:
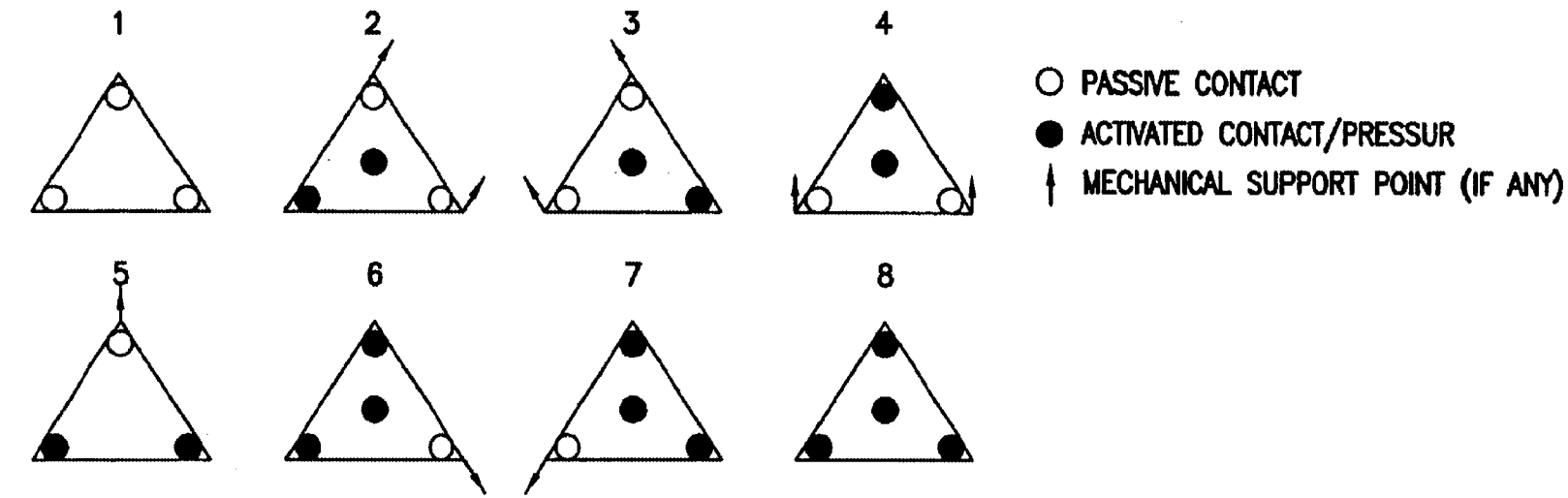

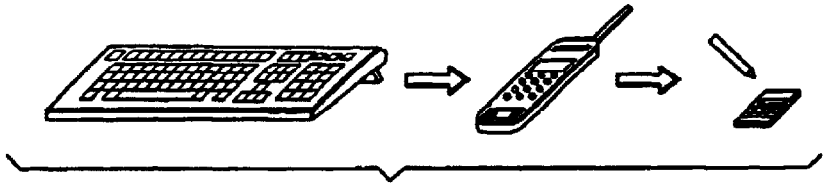
FIG. 1
PRIOR ART
| | | |
|---|---|---|
| 1 | ABC 2 | DEF 3 |
| GHI 4 | JKL 5 | MN 6 |
| PRS 7 | TUV 8 | WXY 9 |
| * | OQZ 0 | # |
FIG. 2
PRIOR ART
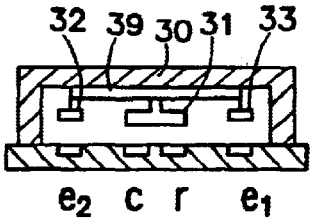
FIG. 3a
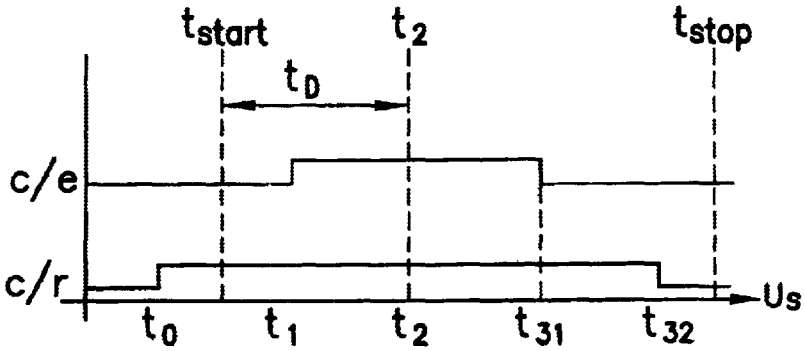
FIG. 3b

KEYBOARD AND KEY AND TELEPHONE APPARATUS WITH SUCH A KEYBOARD

The present invention relates to a keyboard having keys and to a key for inputting characters, wherein the key is arranged to produce a character in response to the press of the key once. Also the invention relates to a telephone apparatus comprising such a keyboard.

The use of mobile phones and other portable devices is also becoming common in the handling and transfer of alphanumeric information. This requires having a small-sized manmachine interface (MMI), which is capable of easily handling more than 30 letters, numbers from 0 to 9, and about ten special characters (+, #, *, etc.), i.e., a total of, for example, 50 characters or more. The entity of the produced characters is called a set of characters. The operational requirement is the same as, e.g., that of a computer keyboard, but the size should be considerably smaller, and the device should also be suitable for mobile use in other ways. An additional requirement made of the device is, e.g., good manufacturability and low costs, as well as suitability for different kinds of user environments and for the implementation of many different types of sets of characters. The device, presented here, which meets these requirements, is called a keyboard while an alphanumeric keyboard is called an A/N keyboard.

One way of reducing the size of an A/N keyboard is to reduce the size of an individual key to the extent that the keys are handled by means of a special manipulator instead of using fingers such as a stick, as indicated by the development path of the miniaturisation of an A/N keyboard, shown in FIG. 1. Another way is to make one key serial-operationally multi-functioning, i.e., sequential, so that, within a specific time window, one press denotes a number, two presses a first letter, three presses a second letter, etc. For example, an A/N keyboard used with motions, currently in use the Global System for Mobile Communications. GSM phones, functions in this way, as shown in FIG. 2. The keyboard functions merely as a numeric keyboard and, when separately selected, on an A/N keyboard, so that one press within a specific period of time (e.g., approx. one second) denotes a first letter alternative, two presses a second letter alternative, etc. In a widely known solution, the sensitivity of a key to the number of presses can be adjusted so that the key either identifies several presses or each press is followed by the main alternative, i.e., usually the selection of a number. The pressing of a key is identified by electronics, so that the pressed key connects a row conductor, at the point of the key, to a column conductor, located at the same point, and by identifying, by means of electronics, the conductors connected to each other.

The problem of both a traditional and a miniaturised keyboard is that they neither fit in a sufficiently small space nor is it possible to have clear numeric keys on a small A/N keyboard. From the viewpoint of a portable device, the problem is also the number of matrix conductors, required in keyboard coding, which, for e.g. 56 keys is 7+8 (7 rows, 8 columns), and the deformation of the row/column figure of the keyboard, when implementing for e.g., 56 keys physically for a 4*14 row matrix. The advantage of a sequential key function is a clear main function, e.g., numbers, but the disadvantage, from a user's viewpoint,is the slowness of the letter functions and that it is difficult to understand.

A major technical development step should yet be taken from the above-described solutions, e.g., to graphic, interactive keyboards or to identifying writing by a hand movement. Hence, there is still need for a useful A/N keyboard, based on contact.

One solution for a key of a keypad is disclosed in publication DE 36 22 275, in which each key has two contact elements and the key is formed as a rocker button so that when the key is pressed in the middle both contact elements are contacted to activate a middle key function, when the key is pressed at left only the left contact element is contacted to activate a left key function, and when the key is pressed at right only the right contact element is contacted to activate a right key function. This solution allows three different key functions to occur by one press. At the time, however, more than three key functions are desired of one key, especially in mobile phones.

The present invention combines, from a user's viewpoint, a single- and multi-functioning key so that there is only one key for a number of characters, however, so that each character is selected with a single press of the key. The present invention allows in the preferred embodiments 8–10 different key functions for each key by a single press of the key. As for its manufacture, the device is economical, because the number of conductors required for keyboard coding such as row and column conductors are smaller than in the well-known two-dimensional matrix conductor solutions. Therefore, e.g., 56 characters, which in matrix coding require 15 (7+8) conductors, can be decoded by means of 11 conductors which consist of the row and column conductors of a 4*4 matrix, as well as three conductors identifying the keyboard edge, thereby easily enabling the coding of more than 64 different kinds of characters.

The invention is characterized by that the key has a main contact which is always activated when the key is pressed, and at least one edge contact, which is activated, in addition to the main contact, when the key is pressed at the point or close to the point of the edge contact, and the activation of predetermined contacts correspond to the inputting of a predetermined character.

Figure 4B:
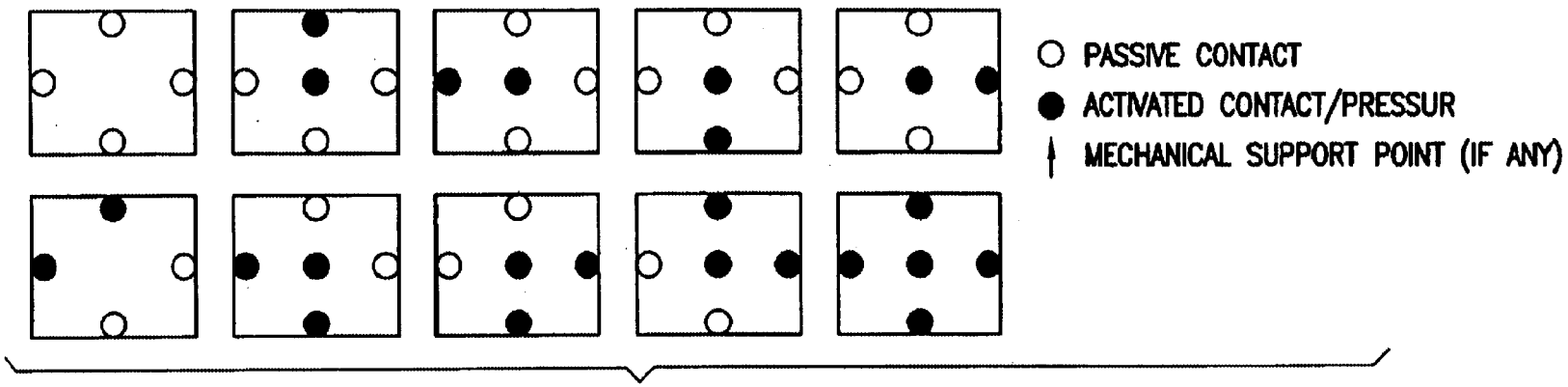
Figure 5:
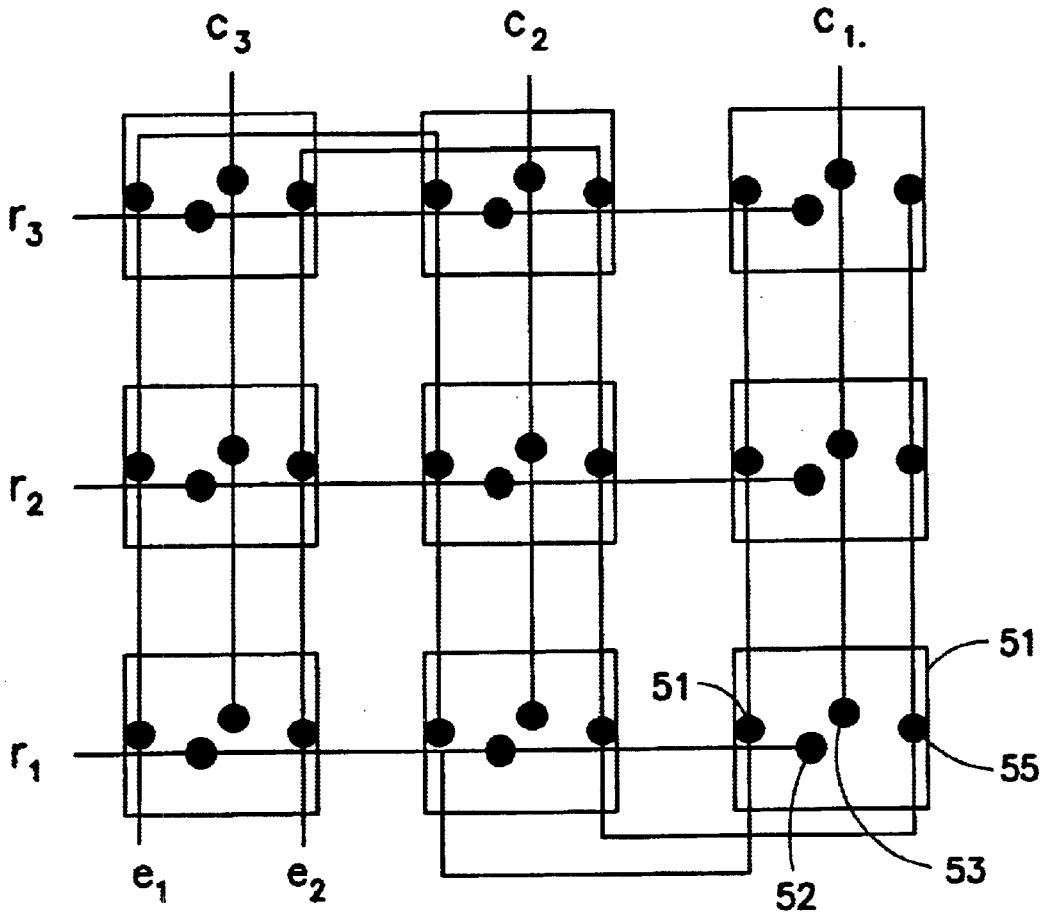

The invention will be described in following by reference to the attached drawings, in which FIG. 1 shows the development path of the miniaturisation of an A/N keyboard, FIG. 2 shows a prior art keypad of a mobile phone, FIG. 3*a* shows a mechanical principle of the invention, FIG. 3*b* shows and a timing diagram of contacts, FIGS. 4*a* and 4*b*, respectively, show contact combinations of triangular and quadrangular keys, and FIG. 5 shows an electrical principle of the invention and its application.

Figure 6:
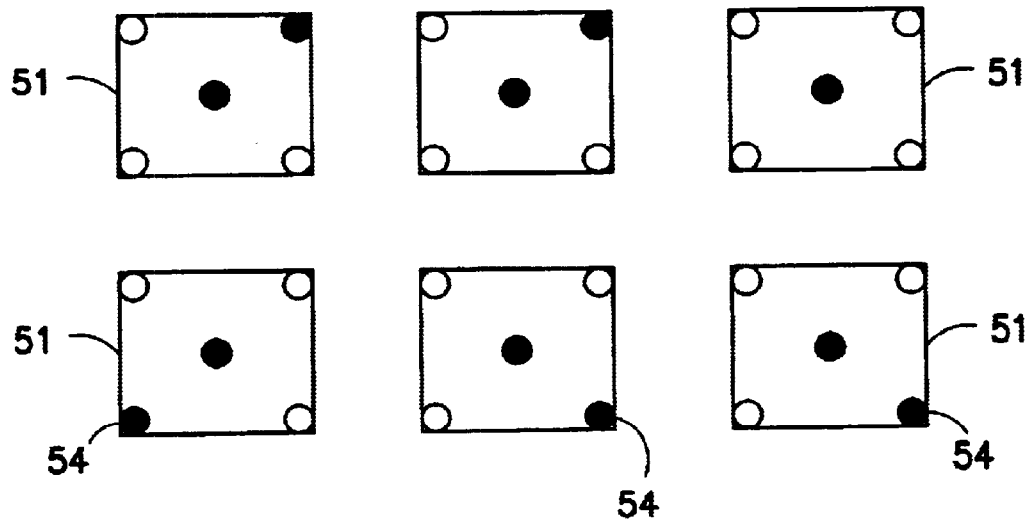

FIG. 6 shows keys with corner contacts.

FIG. 3*a* shows one example of the structure of a key according to the invention. The mechanical basic structure of a key 30, shown in FIG. 3*a*, is such that a center contact 31 in the key, which is, e.g. of electricity conducting plastic, forms, at first, a contact between c(olumn) and r(ow) conductors. The center contact 31 of the key 30 and edge contacts 32, 33 . . . are in an electricity conducting contact with each other and consist of, e.g., a common electricity conducting plastic part 39. On the basis of this c/r contact, the key that has been pressed is identified on a keyboard consisting of a number of keys. When the key 30 is pressed further, at the point of a corner contact, a second contact is formed, underneath the key, between the conductor c and one of the edge conductors. The center or main contact 31 and the edge contact(s) 32,33 each comprise a separate protrusion wherein each protrusion has a contact pad located at the end of the protrusion.

When the key is pressed in the center area, only the c/r contact is formed, which denotes the main character alternative of the key in question. When the key is pressed on one of the edges, at first, the contact c/r is formed and then, after a short expanse of time, a second contact c/e is formed, which denotes the selection of some secondary character alternative of the key in question.

By means of electronics that identify the functioning of the key, the keyboard can be set to such a mode, that it only identifies the contacts c/r, or the contacts c/r and c/e. It is also possible that electronics can also identify multiple presses. As for timing, it is essential that the contact c/r, and the contact c/e, which could be formed after that, will be identified to have formed quickly enough after the formation of the contact.

One possible identification process is shown in FIG. 3*b* by means of a timing diagram. The contact c/r is formed at the point of time of $t_0$, and it is identified by the electronic equipment at the point of time of $t_{start}$. From thereon, the point of time of $t_2$ will be anticipated, at which time a possible second contact c/e will be identified, and a decision on the key function will be made. When pressing a key in one of the corners, a second contact will be formed at the point of time of $t_1$. Thus, the actual difference in time between the contacts c/r and c/e is $t_1-t_0$, and the identification of the entire key function will last for a period of time of $t_D=t_2-t_0$. Typically, $t_D$ is equal to 50 ms.

When the key is released, the contact c/e will open at the point of time of $t_{31}$ first and, after that, the contact c/r will open at the point of time of $t_{32}$, which will be identified at the point of time of $t_{stop}$. Hence, the duration of the entire key function is $T_{tot}=t_{stop}-t_{start}$. Typically, $T_{tot}$ is equal to 100–300 milliseconds. Thus, the key described above makes it possible to produce alphanumeric characters at the rate of three characters a second and, in principle, even as many as ten characters a second.

As for the method, it is not essential whether contacts 31, 32, 33, etc. are mechanical switches, e.g., well-known membrane keys on a circuit board, or plastic keys as described above. The most essential function is based on one or more contacts and on their order of formation, so that the identification of a character can be made on the basis of the activation of the main contact. This can be done in accordance with the example described here, so that all the contacts are assumed to be activated after a specific period of time from the activation of the main contact. A second alternative is that the main contact will be the last to activate, in which case the character can be identified immediately in connection with the activation of the main contact. As for mechanical implementation, the former method of implementation is more natural. There are no limitations to the number of edge contacts either, but three and four edge contacts are preferred. Three is preferable because, when one edge is pressing, two other edges form an axle, which supports the inclination of the key and, in addition, the contact part of a triangular key can be pressed in three different ways: only on the center area, on the center area and on one edge, and on two edges. This enables seven different singletouch characters by means of one key. The eighth character is the pressing of the key, so that all the contacts are activated, i.e., in a triangular key, all binary combinations of edge conductors $E_1$–$E_3$ are possible. Four edge contacts are well suited to quadrangular keys, although, e.g., the center contact 31 should be used as a support point for the key's movement, if the only aim is to activate one edge contact. In a quadrangular key, the activation of two edge contacts is ideal.

By comparing the easily implemented contact combinations of triangular and quadrangular keys, as shown in FIG. 4, it can be noted that a triangular contact part is relatively more effective and almost as versatile as a quadrangular key. In FIG. 4, the open circle, drawn inside the key's edge line, denotes an unformed contact and the closed circle denotes a contact formed, by the key being pressed on different points. The contact combinations 1–4 of the triangular key, shown in FIG. 4, are based on the identification of a center contact and one edge contact as described above, and the combinations 5–8 are based on the identification of a center contact and two edge contacts On the triangular keys, arrows have also been drawn to indicate the support points of the counterforce to the force forming a contact. It can be seen that the contact combinations 2–4 of the triangular key are preferable in the sense that two support points are formed on the opposite edge for each edge contact, and the movement of the key is an easily controlled swaying motion on an axle formed by them.

FIG. 5 shows an electrical connection for a 3*3 contact keyboard, wherein each of the keys has three single-press functions. Let us study a key 51, in the center area, of which there is a row contact of 52 and a column contact of 53, which are connected to a row conductor $r_1$ and a column conductor $c_1$, respectively. In addition, underneath the key, there is an edge contact of 54, connected to an edge conductor $e_1$, and an edge contact 55, connected to an edge conductor $e_2$. When pressing the key 51 in the center, the contacts 52 and 53 connect the row conductor $r_1$ and the column conductor $c_1$ together, whereby the control electronics will identity that the key 51 has been pressed. (No contact is formed between the edge conductors $e_1$, $e_2$ . . . at this point.) When the key 51 is pressed, e.g., at the point of a contact 54, the key will connect the contact points 52 and 53 and, a little later, also the contact point 54. Electronics will identify that the row conductor $r_1$, the column conductor $c_1$ and the edge conductor $e_1$ have been connected together, and interpret that the key 51 has been pressed on the edge, at the point of the contact 54. Thus, a keyboard, according to this example, is capable of identifying 3*3*3, i.e., 27 different characters on the basis of two contacts formed. More generally, the number of characters $N_{tot}$, which can be identified by means of a center contact and, in addition to it, by means of one edge contact, is $$N_{tot}=N_r*N_c*(1+N_e)$$

where $N_r$ is the number of row conductors, $N_c$ is the number of column conductors, and $N_e$ is the number of edge conductors. Mechanically, it can also be arranged so that, in addition to a contact in the center area of the key 51, two edge contacts will be activated, in which case, the number of characters to be produced by means of a single press of a single key will increase further. If a large number of special characters should be produced, a well-known method can also be used in order to implement a multi-functioning keyboard and, hence, by means of a single keyboard, also produce, e.g., in addition to the main characters of the Latin alphabet, Germanic and Scandinavian characters.

In addition to its small size, usability, simplicity, profitability, and economy, the advantages of the solution presented here are also its suitability for a number of different types of sets of characters, as well as for the handling of numbers and letters without mutual limitations.

To a person skilled in the art, it is also obvious that keyboards can be compiled and used in different ways depending on their use. Sometimes, only one character is identified per key, sometimes all the single-press characters per key, and sometimes, in addition to these, also the characters that require several presses as well. The present solution is also suitable for the implementation of a telephone keyboard in accordance with the recommendations of the center. An example of a telephone apparatus in which a keyboard according to the invention can be used is a mobile phone, e.g. which is shown in the middle of FIG. 1. It is also apparent, that when the contact part of a key is essentially in the shape of a triangle or a quadrangle, as described above, the part that is visible to a user can be designed in accordance with the current requirements or trend. It is also possible to implement keyboards, which permanently have different types of keys. Thus, the field of application of the present invention is only restricted by the enclosed claims.

What is claimed is:

1. A keyboard having keys for inputting characters, each of said keys having a face adapted to be engaged for actuation of said key, at least one of said keys being arranged to correlate to a character in response to pressing once on said face of said at least one key, said at least one key being arranged to move when pressed in a direction generally normal to said face, said at least one key having a main contact which is always activated when said at least one key is pressed in said direction and at least one edge contact which is activated, in addition to the main contact, when said at least one key is pressed in said direction at a point of said edge contact or close to said point, wherein an activation by said at least one key of predetermined contacts corresponds to an inputting of a predetermined character, wherein said main contact is spaced from said at least one edge contact and wherein said main contact comprises a main contact pad which is separate and spaced from an edge contact pad of said at least one edge contact.

2. A keyboard according to claim 1, wherein the key comprises three edge contacts arranged in a triangular form.

3. A keyboard according to claim 2, wherein the key has a triangular shape and each edge contact is located at an apex of the triangle.

4. A keyboard according to claim 1, wherein the key comprises four edge contacts arranged in a quadrangular form.

5. A keyboard according to claim 4, wherein the key has a quadrangular shape and each edge contact is located at a corner of the quadrangle.

6. A keyboard according to claim 4, wherein the key has a quadrangular shape and each edge contact is located along the side of the quadrangle.

7. A keyboard as in claim 1 wherein said main contact and said edge contact each comprise a separate protrusion, and wherein said main contact pad and said edge contact pad are located at respective ends of said protrusions.

8. A keyboard as in claim 1 wherein said main contact and said at least one edge contact are electrically connected to one another.

9. A keyboard as in claim 1 wherein, when said at least one edge contact is actuated, said at least one key is adapted to always activate said main contact before said at least one edge contact is actuated.

10. A telephone apparatus comprising a keyboard having keys for inputting characters, each of said keys having a face adapted to be engaged for actuation of said key, at least one of said keys being arranged to correlate to a character in response to pressing once on said face of said at least one key, said at least one key being arranged to move when pressed in a direction generally normal to said face, said at least one key having a main contact which is always activated when said at least one key is pressed in said direction and at least one edge contact which is activated, in addition to the main contact, when said at least one key is pressed in said direction at a point of said edge contact or close to said point, wherein an activation by said at least one key of predetermined contacts corresponds to an inputting of a predetermined character, wherein said at least one edge contact comprises a contact area which is separate from a contact area of said main contact and wherein said main contact comprises a main contact pad which is separate and spaced from an edge contact pad of said at least one edge contact.

11. A telephone apparatus as in claim 10 wherein said main contact and said edge contact each comprise a separate protrusion, and wherein said main contact pad and said edge contact pad are located at respective ends of said protrusions.

12. A telephone apparatus as in claim 10 wherein said main contact and said at least one edge contact are electrically connected to one another.

13. A telephone apparatus as in claim 10 wherein, when said at least one edge contact is actuated, said at least one key is adapted to always activate said main contact before said at least one edge contact is actuated.

14. A key for inputting characters, said key having a face adapted to be engaged for actuation of said key, said key being arranged to correlate to a character in response to pressing once on said face of said key, said key being arranged to move when pressed in a direction generally normal to said face, said key having a main contact pad which is always activated when said key is pressed in said direction and at least one edge contact pad which is activated, in addition to the main contact pad, when said key is pressed in said direction at a point of said edge contact pad or close to said point, wherein an activation by said key of predetermined contact pads corresponds to an inputting of a predetermined character, and wherein said main contact pad and said at least one edge contact pad are separate and spaced from one another.

15. A key as in claim 14 wherein said main contact pad and said edge contact pad are located at respective ends of separate protrusions.

16. A key as in claim 14 wherein said main contact pad and said at least one edge contact pad are electrically connected to one another.

17. A key as in claim 14 wherein, when said at least one edge contact pad is actuated, said key is adapted to always activate said main contact pad before said at least one edge contact pad is actuated.

* * * * *